US006092871A

United States Patent [19]

Beaulieu

[11] Patent Number: 6,092,871

[45] Date of Patent: Jul. 25, 2000

[54] LUMBAR SUPPORT

[75] Inventor: Jocelyn Beaulieu, Newmarket, Canada

[73] Assignee: Global Total Office, Downsview, Canada

[21] Appl. No.: 09/429,621

[22] Filed: Oct. 29, 1999

[51] Int. Cl.[7] ..... A47C 7/46

[52] U.S. Cl. ..... 297/284.4

[58] Field of Search ..... 297/284.4, 284.1, 297/284.7, 284.8

[56] References Cited

U.S. PATENT DOCUMENTS 4,182,533 1/1980 Arndt et al. .
4,313,637 2/1982 Barley .
4,531,779 7/1985 Hashimoto ..... 297/284.4
4,601,514 7/1986 Meiller ..... 297/284.4
5,217,278 6/1993 Harrison et al. .
5,609,394 3/1997 Ligon, Sr. et al. ..... 297/284.4

*Primary Examiner*—Peter R. Brown
*Attorney, Agent, or Firm*—Bereskin & Parr

[57] ABSTRACT

An office chair incorporates a lumbar support in the lumbar region of the back of the chair. The support includes an arcuate lumbar support element and a carrier for the element, which is pivotally coupled to the back for movement between positions in which the support element provides respectively maximum and minimum support for the lumbar region of the person using the chair. The carrier can be locked in an adjusted position. The support element is resiliently flexible so that its curvature varies between a maximum in the maximum support position and a minimum in a minimum support position of the lumbar support.

9 Claims, 5 Drawing Sheets

LUMBAR SUPPORT

FIELD OF THE INVENTION

This invention relates generally to seating and is concerned more particularly with seats that include a support for the lumbar region of a person using the seat.

BACKGROUND OF THE INVENTION

It has long been recognized as desirable to incorporate a lumbar support in the back of a seat. Particularly in the field of seats for automotive use, many different forms of lumbar support have been proposed. Examples are disclosed in U.S. Pat. Nos. 4,182,533 (Arndt, et al.), 4,313,637 (Barley) and 5,217,278 (Harrison, et al.). In general, these patents disclose lumbar supports that can be set at various positions in which the support protrudes from the seat back to provide different degrees of support.

In general, seats for office chairs have included only fixed (non-adjustable) lumbar supports.

Accordingly, an object of the present invention is to provide a lumbar support which is suitable primarily (not exclusively) for use in an office chair, and which is adjustable to provide different degrees of support.

SUMMARY OF THE INVENTION

The present invention provides a seating unit such as a chair having a seat, a back, and a lumbar support incorporated in the lumbar region of the back. The lumbar support includes a lumbar support element having a shape which is arcuate about an axis that extends generally transversely of the seat back so that the element extends outwardly of the back for providing support to the lumbar region of a person using the chair. A carrier for the lumbar support is pivotally coupled to the back for movement about an axis parallel to the axis of the lumbar support element, between positions in which the support element provides respectively maximum and minimum support of the lumbar region of a person using the chair. The chair also includes locking means operable by that person for locking the carrier in each of the maximum and minimum support positions and in any of a number of intermediate positions for providing different degrees of lumbar support. The lumbar support element is coupled to the carrier at a location intermediate top and bottom end portions of the element, one of which abuts the carrier and the other of which abuts the chair back. The element is resiliently flexible so that its curvature varies between a maximum in said maximum support position of the lumbar support element and a minimum in said minimum support position of the element.

The chair of the invention provides a lumbar support which is adjustable to provide different degrees of support to the lumbar region of a person using the chair. The actual support surface is provided by an arcuate lumbar support element that is resiliently flexible so as to automatically adopt different curvatures appropriate to the particular position to which the support has been adjusted.

The lumbar support can be "active" or "passive". In the active mode, the user can press against the lumbar support element with his or her back until a desired position is reached and then lock the support in that position. In the passive mode, the locking means is inactive and the lumbar support element can free float to follow movement of the user's body.

As noted previously, the invention has been devised primarily in the context of an office chair. However, in principle, the invention may be applied to chairs for other applications, including automotive seats.

The carrier locking means may take a number of different forms. Preferably, the carrier incorporates a series of teeth that move past a stationary detent as the carrier pivots about its pivot axis, and the detent can be advanced to engage between a particular pair of teeth for locking the carrier in an adjusted position. Preferably, the detent is cable operated from an actuator that is accessible to a person seated in the chair. For example, a two-position button actuator of the form disclosed in U.S. Pat. No. 5,899,530 (Tedesco) may be incorporated in an arm of the chair.

The mechanism comprising the lumbar support element, carrier and locking means typically will be mounted in a recess in the lumbar region of the back of the chair and will covered by appropriately padded upholstery so that the back presents generally the shape and appearance of a normal chair back. As the lumbar support element is moved between its minimum and maximum support positions, the user will visually discern a change in the shape of a gentle arcuate "bulge" in the lumbar region of the back of the chair formed by the lumbar support element.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
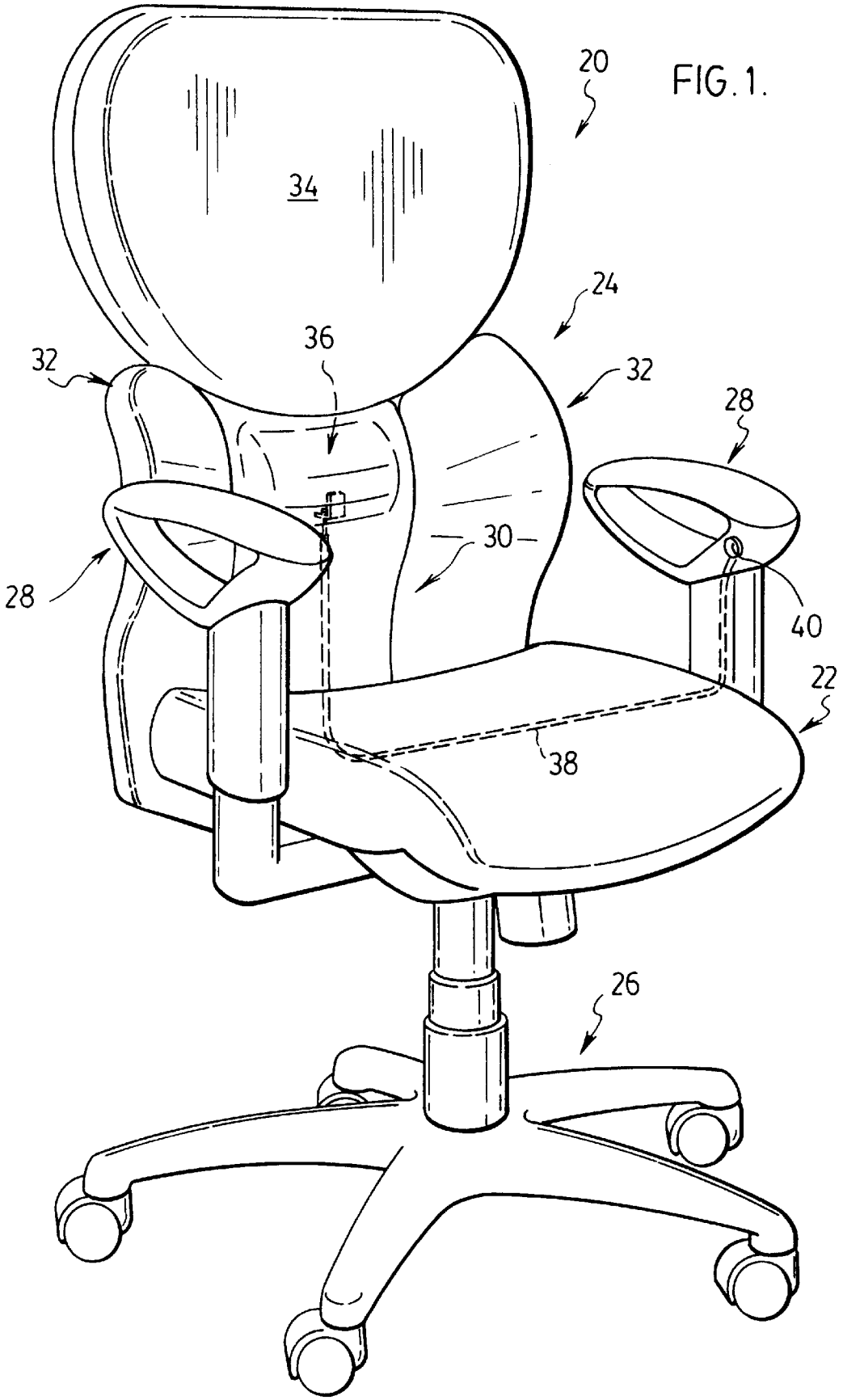
FIG. 1 is a perspective view of an office chair in accordance with the invention.

Referring first to FIG. 1, an office chair is generally denoted by reference numeral 20 and includes a seat 22 and a back 24. A conventional wheeled chair base 26 supports the seat 22. Arms at respectively opposite sides of the seat are indicated at 28.

In this particular embodiment, the back 24 of the chair is designed to include a centre back section 30 having "wings" 32 on respectively opposite sides and an enlarged shoulder support portion 34 at the top.

A lumbar support generally indicated at 36 is provided in the centre back section 30 at a position to correspond with the lumbar region of a person using the chair. As noted previously, in an actual chair, the lumbar support 36 will be visible only through the upholstery of the chair, as a convexly curved "bulge" or protrusion in the centre back section 30.

FIG. 1 also shows generally, at 38, an actuator cable extending from the lumbar support 30 to a push button 40 in one of the arms 28 of the chair.

Figure 2:
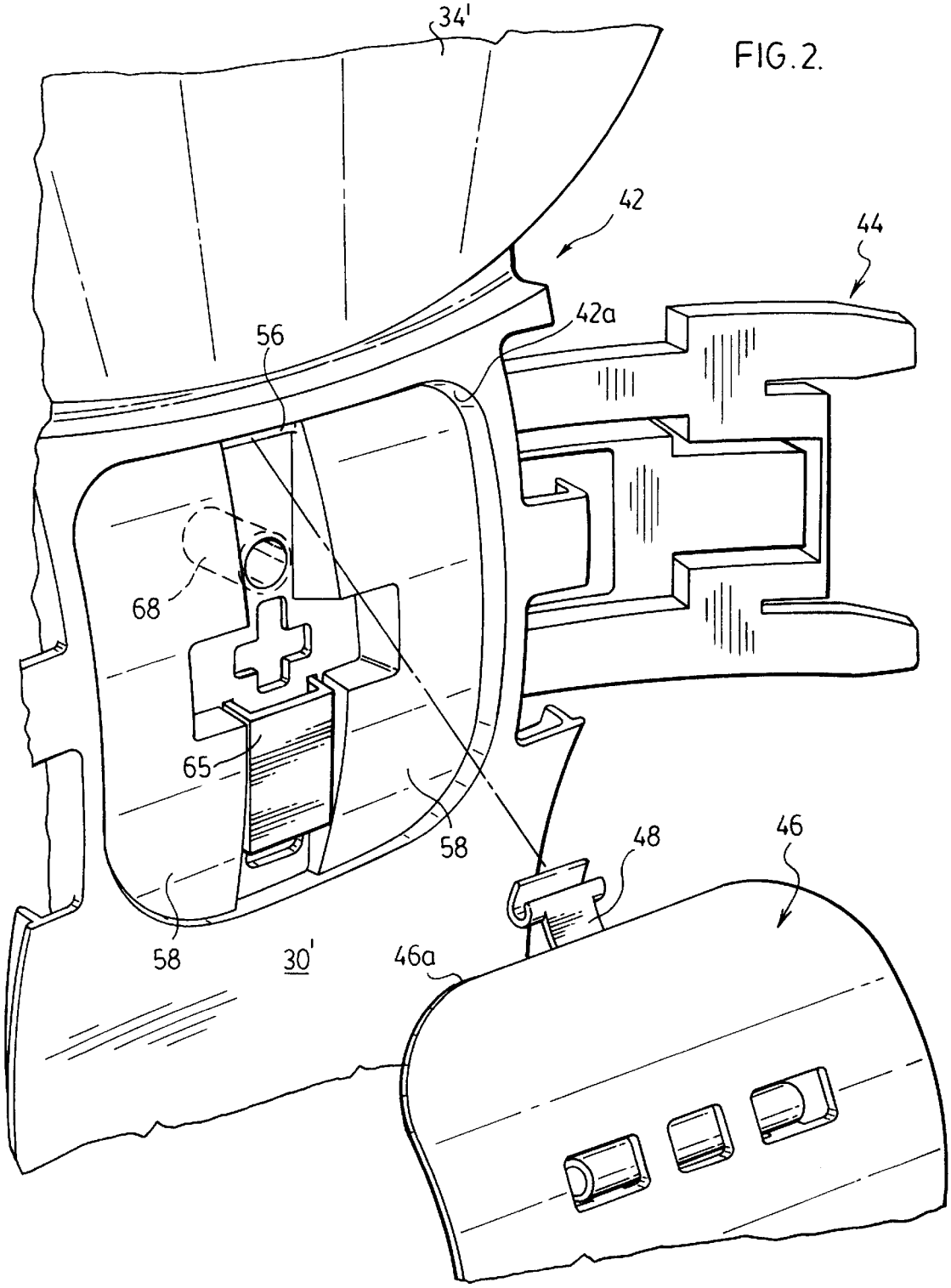
FIG. 2 is a perspective view showing the lumbar support element in an "exploded" position clear of the back of the chair.

FIG. 2 shows part of the back 24 of the chair without its upholstery. In this embodiment, the back comprises a one-piece plastic moulding 42 that forms the "core" of the centre back section 30 and the top portion 34 of the back as shown in FIG. 1. In fact, most of the components of the chair structure and lumbar support are plastic mouldings (though this is not essential to the invention).

In FIG. 2, the part of the plastic moulding 42 that forms the centre section of the back 24 is denoted 30' and the part of the moulding that defines the top portion 34 is denoted 34'. Extending outwardly to opposite sides of the centre portion 30' of the moulding 42 are formations that support the "wings" 32 (FIG. 1). One of those formations is visible at 44. Reference may be made to our co-pending patent application of even date herewith entitled "Chair Wing Structure" for details of this part of the chair.

Shown in an exploded position forwardly of the back of the chair is a lumbar support element 46 (which is also a plastic moulding). In the assembled chair, this element is received in a recess 42*a* that is formed in the centre back section 30' of moulding 42. Part of a carrier for the lumbar support element is visible at 48.

Figure 3:
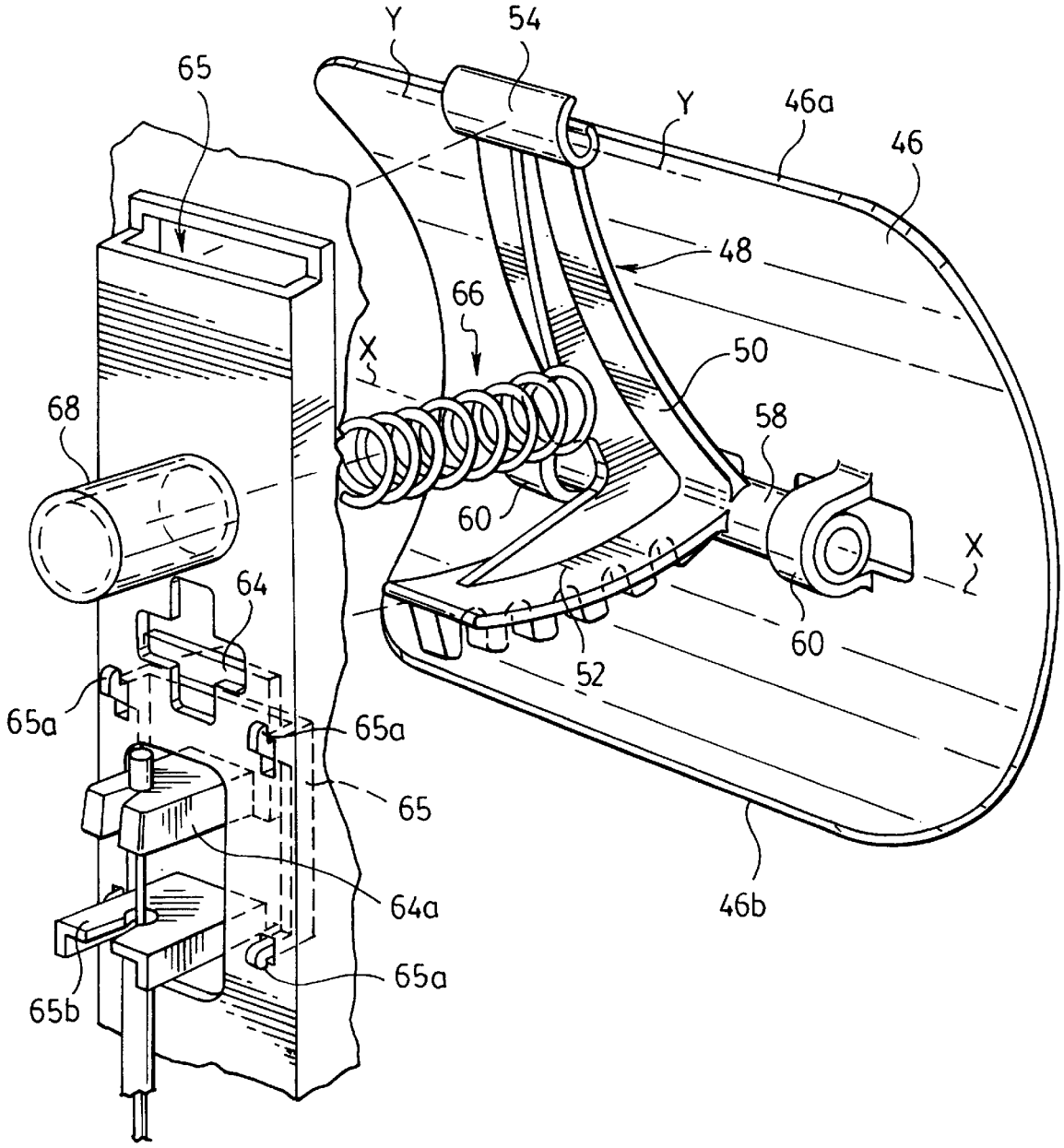
FIG. 3 is a perspective view from the rear of the lumbar support element, associated carrier and locking means; and, FIGS. 4, 5 and 6 are vertical sectional views through the lumbar support mechanism, showing the support element in different operational positions.

FIG. 3 shows the lumbar support element 46 and the carrier 48 as seen from the rear in FIG. 2. It will be seen that the lumbar support element 46 has a shape which is arcuate about an axis that extends generally transversely of the seat back. In practice, element 46 need not be a precise geometrical formation about a specific axis. Rather, an axis is referred to in order to define the orientation of the curvature of the lumbar support element with respect to the seat back. For the purpose of illustration, the axis may be represented by the axis denoted X—X in FIG. 3.

Carrier 48 has a generally L-shaped configuration as seen from the side, comprising a first, upper limb 50 and a second, lower limb 52. At the top end of the upper limb 50 is a C-shaped formation 54 that defines a pivot axis Y—Y for the carrier that is parallel to axis X—X. In the assembled chair, formation 54 embraces a rib or rail 56 inside the top edge of the recess 48 in the back moulding 42 (see FIG. 2). At the junction between the two limbs 50, 52 of the carrier, a rod 58 extends transversely of the carrier to both sides, where the rod is embraced by a pair of U-shaped formations 60 on the inner face of element 46, for pivotally coupling the element to the carrier 48.

Figure 4:
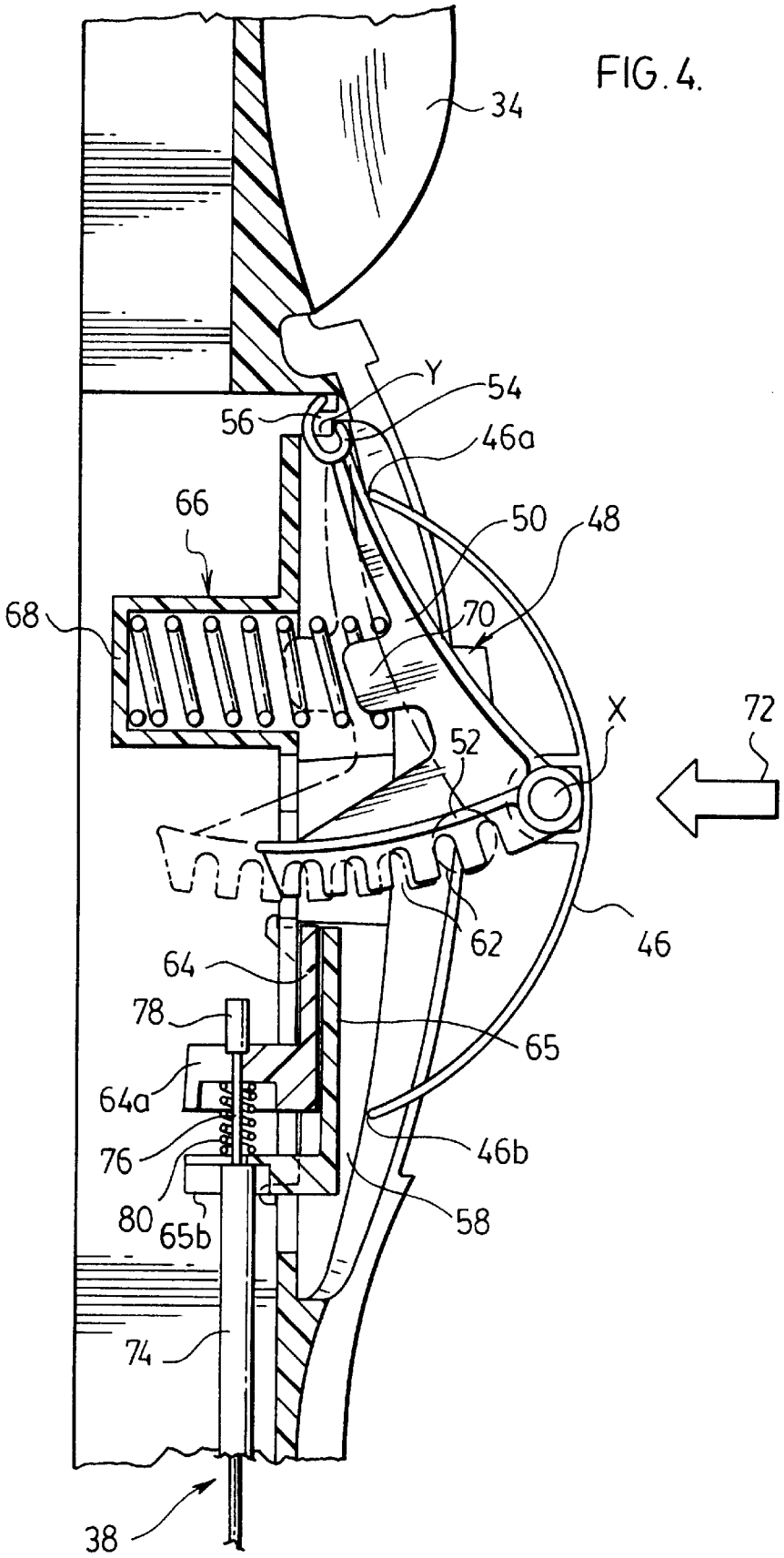
Figure 5:
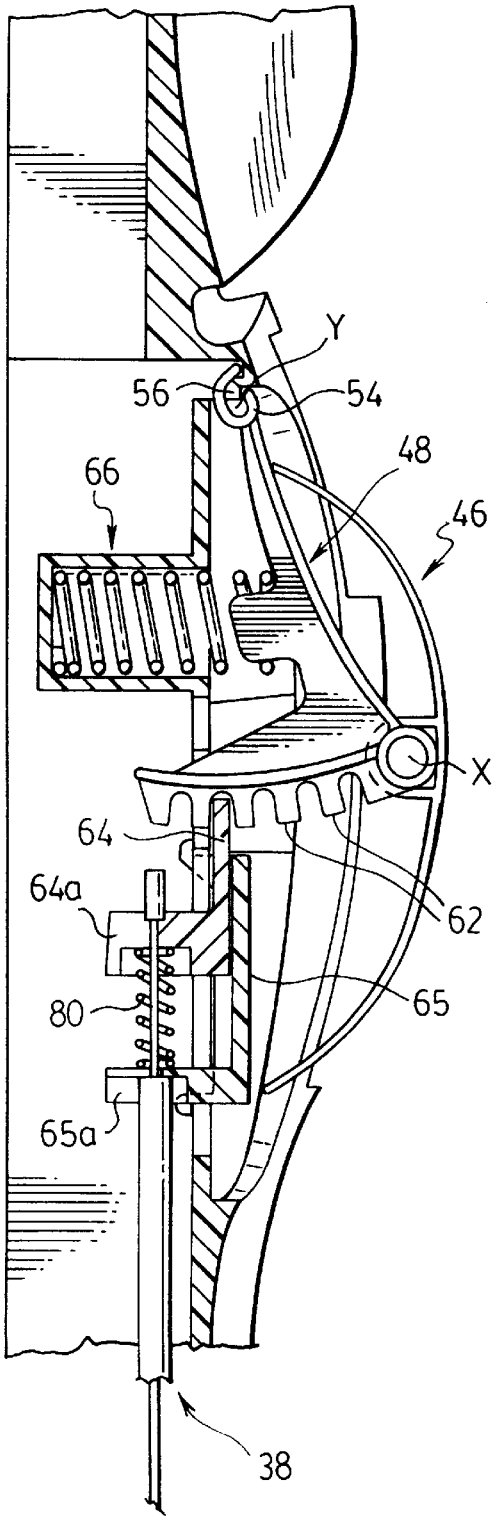
Figure 6:
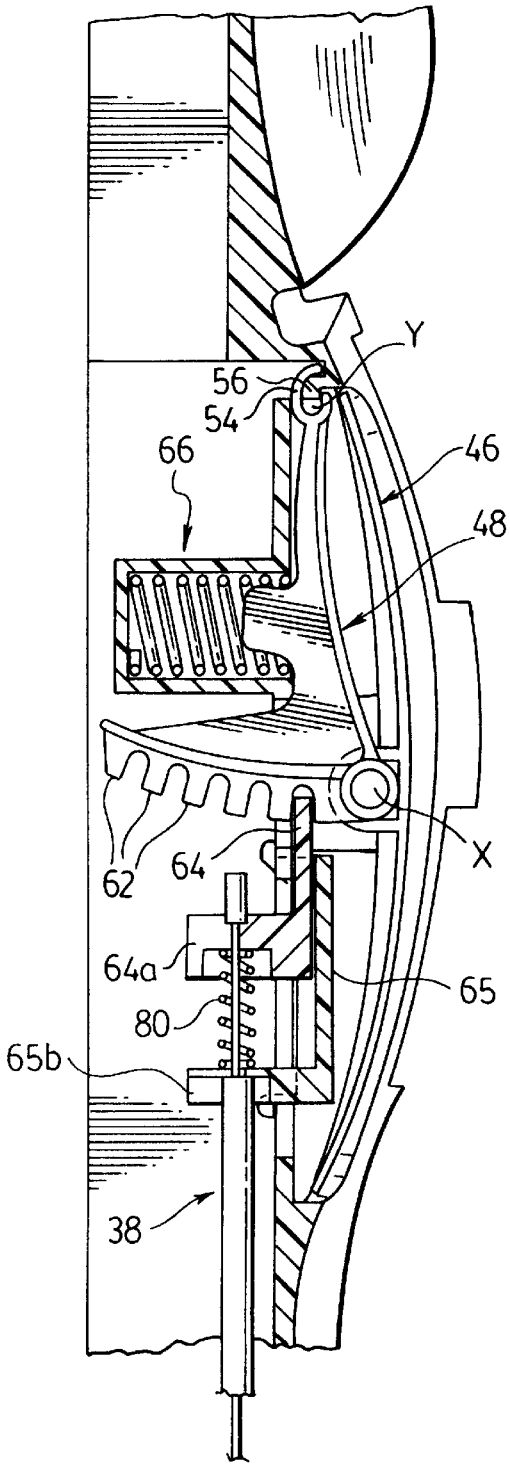

Referring now to FIGS. 4, 5 and 6, it will be seen that the pivotal coupling between the carrier 48 and the back of the chair (axis Y—Y) allows the carrier to move between positions in which the support element 46 provides respectively maximum (FIG. 4) and minimum (FIG. 6) support for the lumbar region of a person using the chair. FIG. 5 shows an intermediate position.

Reverting to FIG. 3, it will be seen that the lumbar support element 46 is coupled to the carrier 48 at a location intermediate top and bottom end portions 46*a* and 46*b* respectively of the element. As best seen in FIGS. 4, 5 and 6, in the assembled chair, the upper end portion 46*a* of element 46 abuts against the upper limb 50 of the carrier, while the lower end portion 46*b* of element 46 abuts against respective side support surfaces 58 within the recess 48 in the chair back (FIG. 2). Accordingly, the ends of elements 46 are supported so that the element itself can resist the pressure of a person using the chair, leaning against the element. The surface portions 58 of the back moulding 52 are convexly curved and the outer surface of the upper limb 50 of the carrier 48 is concavely curved, and the element 46 itself is resiliently flexible. Accordingly, as the carrier pivots between its maximum and minimum support positions, the end portions 46*a* and 46*b* will slide along their respective support surfaces and the contour of the lumbar support element will change for providing different support characteristics. At the same time, the element will be firmly supported against the carrier and seat back so that firm lumbar support is provided to the user in all configurations.

As best seen in FIGS. 4, 5 and 6, the bottom limb 52 of the carrier 48 extends inwardly from axis X (the connection between the carrier and the support element 46) about an arc that is centred on the pivot axis Y—Y for the carrier. Formed along the bottom surface of limb 52 are a series of teeth 62 that are spaced along the limb. As the carrier pivots about axis Y—Y, these teeth move past a detent 64 that is located in a fixed position with respect to the chair back. Detent 64 can be moved between advanced and retracted positions to either engage between adjacent ones of the teeth 62 to lock the carrier in a defined position, or stand clear of the carrier, so that the carrier can move freely. As best seen in FIG. 3, detent 64 is simply a flat plate that slides vertically in a slideway defined by a channel-shaped retainer 65 that is clipped to the back moulding 42 via legs 65*a*.

Detent 64 is shown in a retracted position in FIG. 4 and in its advanced position in FIGS. 5 and 6. FIG. 4 shows the "maximum support" position, in which the carrier has moved to the right as shown (outwardly of the back) as far as is possible and the lumbar support element 46 is in its configuration of maximum curvature. A compression spring 66 in fact biases the carrier to this position. Spring 66 is housed in a cylindrical pocket 68 that is formed in part of the plastic moulding 42 at the rear face of the recess 48 shown in FIG. 2. The forward end of spring 66 fits over a protrusion 70 on the rear side of the upper limb 50 of carrier 48, as best seen in FIGS. 4, 5 and 6.

As seen in FIG. 4, the lumbar support element 46 is in this maximum support position and the detent 64 of the locking means is retracted. As such, a force acting in the direction of the arrow shown at 72 (by a person seated on the chair pushing against the lumbar support) will cause the carrier 48 to pivot rearwardly and the lumbar support element 46 to tend to flatten in shape. When a desired adjusted position is reached, the detent is advanced to lock the carrier, and thereby hold the lumbar support in the required configuration. FIG. 5 shows a typical such adjusted position. Detent 64 is shown to have advanced between an adjacent pair of teeth, locking the lumbar support in the configuration shown. In FIG. 6, on the other hand, the lumbar support has been moved to its minimum support position and locked in that position by detent 64.

As noted previously, the locking means of the carrier of the lumbar support is controlled by a cable 38 from a push button 40 in an arm of the chair (see FIG. 1). The push button 40 is of the form disclosed in the Tedesco '530 patent (supra), the disclosure of which is incorporated herein by reference. Referring now to FIGS. 4, 5 and 6, the cable 38 has a stationary outer housing 74 and an inner core 76 that moves to operate the detent 64. A fixture 78 on the outer end of core 76 engages an arm 64*a* that extends rearwardly from detent 64 as best seen in FIG. 3. A spring 80 acts between arm 64*a* and a fixed arm 65*b* on retainer 65 to bias the detent towards its advanced position. Arm 65*b* also acts as a stop for the outer housing 74 of cable 38.

The push button disclosed in the '530 patent has a "click-on", "click-off" mechanism. As applied to the present invention, pushing the button a first time will cause the cable 38 to, say, be withdrawn, moving the detent 64 to the retracted position shown in FIG. 4. The button will then latch in this position. Pushing the button a second time will release the cable so that the spring 80 can advance the detent to its locating position.

When the detent is retracted, the lumbar support can free float to follow movement of the user's body ("passive"

mode) or the user can reconfigure the lumbar support (by pressing with his or her back) until a desired position is reached and then press the button again to locate the lumbar support in the desired adjusted position ("active" mode).

It is not essential within the broad scope of the invention to use this form of actuator for the locking means. For example, a simple lever or other actuator could be used to withdraw the core of cable 38 without latching in the retracted position. Other forms of locking mechanism could be used, for example, a friction brake type.

In summary, the present invention provides a lumbar support, for example for an office chair, in which provision is made to allow adjustment of the configuration of the lumbar region of the chair, for providing different support characteristics.

It will of course be appreciated that the preceding description relates to a particular preferred embodiment and that many modifications are possible within the broad scope of the claims. Some of those modifications have been indicated previously and others will be apparent to a person skilled in the art. For example, as indicated previously, the various components of the chair structure and of the lumbar support are plastic mouldings in the preferred embodiment. However, this is not essential within the broad scope of the invention. In the preferred embodiment, a compression spring 60 is used to bias the lumbar support to its position of maximum support. However, the spring may not be essential. For example, it may be possible to rely on the inherent resiliency of the lumbar support element 46 to perform this function. It should also be noted that, while the drawings show an office chair, the principles of the invention may be incorporated in other forms of seating unit, even a seat back for an automotive seat.

I claim:

1. A seating unit having a seat, a back, and a lumbar support incorporated in the lumbar region of the back, wherein the lumbar support comprises:

a lumbar support element having a shape which is arcuate about an axis that extends generally transversely of the seat back, the element extending outwardly of the back for providing support to the lumbar region of a person using the seating unit;

a carrier for the lumbar support element pivotally coupled to the back for movement about an axis parallel to said axis of the lumbar support element, between positions in which the support element provides respectively maximum and minimum support for the lumbar region of a person using the seating unit; and, locking means operable by a said person for locking the carrier in each of said maximum and minimum support positions and in any of a number of intermediate positions for providing different degrees of lumbar support;

wherein the lumbar support element is coupled to said carrier at a location intermediate top and bottom end portions of the element, one of which portions abuts the carrier and the other of which abuts the chair back, and wherein the element is resiliently flexible so that its curvature varies between a maximum in said maximum support position of the lumbar support element, and a minimum in said minimum support position of the element.

2. A seating unit as claimed in claim 1, wherein the locking means comprises a detent which is stationary with respect to the seat back, a series of teeth on the carrier disposed to move successively past the detent as the carrier pivots about its said axis, the detent being movable from a retracted position clear of the carrier and an advanced position in which the detent engages between two adjacent teeth of the carrier, and actuator means operable by a person seated on the seat, for moving the detent between its advanced position and its retracted position.

3. A seating unit as claimed in claim 2, wherein the detent is spring-biassed to its advanced position, and the actuator means includes a cable and operating means accessible to a person using the seating unit for displacing the cable so as to retract the detent against its spring biassing.

4. A seating unit as claimed in claim 3, wherein the operating means comprises a push button adapted to be locked in either of two positions, in one of which the cable is displaced to retract the detent, and in the other of which the cable is free to allow the detent to move under said spring biassing to its advanced position.

5. A seating unit as claimed in claim 4, wherein the seat has a pair of arms and the push button is located in one of the arms.

6. A seating unit as claimed in claim 2, wherein the carrier comprises an L-shaped component having an upper limb which is pivotally coupled at its outer end to the back of the seating unit for movement about said axis, and a lower limb that extends rearwardly from said lumbar support element and which has a lower surface provided with said teeth, the lumbar support element being coupled to said carrier at a location between said limbs.

7. A seating unit as claimed in claim 1, further comprising compression spring means acting between said carrier and said back for biassing the lumbar support to its position of maximum support.

8. In a seating unit having a back and a lumbar support incorporated in the lumbar region of the back;

the improvement wherein said lumbar support comprises:

a lumbar support element having a shape which is acuate about an axis that extends generally transversely of the seat back, the element extending outwardly of the back for providing support to the lumbar region of a person using the seating unit;

a carrier for the lumbar support element pivotally coupled to the back for movement about an axis parallel to said axis of the lumbar support element, between positions in which the support element provides respectively maximum and minimum support for the lumbar region of a person using the seating unit; and, locking means operable by a said person for locking the carrier in each of said maximum and minimum support positions and in any of a number of intermediate positions for providing different degrees of lumbar support;

wherein the lumbar support element is coupled to said carrier at a location intermediate top and bottom end portions of the element, one of which portions abuts the carrier and the other of which abuts the chair back, and wherein the element is resiliently flexible so that its curvature varies between a maximum in said maximum support position of the lumbar support element, and a minimum in said minimum support position of the element.

9. A back for a seating unit incorporating a lumbar support in the lumbar region of the back, wherein the lumbar support comprises:

a lumbar support element having a shape which is arcuate about an axis that extends generally transversely of the seat back, the element extending outwardly of the back for providing support to the lumbar region of a person using the seating unit;

a carrier for the lumbar support element pivotally coupled to the back for movement about an axis parallel to said axis of the lumbar support element, between positions in which the support element provides respectively maximum and minimum support for the lumbar region of a person using the seating unit; and, locking means operable by a said person for locking the carrier in each of said maximum and minimum support positions and in any of a number of intermediate positions for providing different degrees of lumbar support;

wherein the lumbar support element is coupled to said carrier at a location intermediate top and bottom end portions of the element, one of which portions abuts the carrier and the other of which abuts the chair back, and wherein the element is resiliently flexible so that its curvature varies between a maximum in said maximum support position of the lumbar support element, and a minimum in said minimum support position of the element.

* * * * *